US008070562B1

(12) United States Patent
Murrer

(10) Patent No.: US 8,070,562 B1
(45) Date of Patent: Dec. 6, 2011

(54) GRANITE FINISHING TOOLS

(76) Inventor: Daren Paul Murrer, Hamilton, OH (US)

( * ) Notice: Subject to any disclaimer, the term of this patent is extended or adjusted under 35 U.S.C. 154(b) by 1002 days.

(21) Appl. No.: 11/268,346

(22) Filed: Nov. 7, 2005

Related U.S. Application Data

(60) Provisional application No. 60/625,708, filed on Nov. 5, 2004.

(51) Int. Cl.
*B24B 41/06* (2006.01)

(52) U.S. Cl. ..... 451/365; 29/428; 29/700

(58) Field of Classification Search ..... 451/411, 451/365; 29/428, 700
See application file for complete search history.

(56) References Cited

U.S. PATENT DOCUMENTS 1,168,257 A * 1/1916 Kennedy ..... 411/346
3,268,994 A * 8/1966 Harold ..... 29/244
3,946,636 A * 3/1976 Grey ..... 411/346
5,743,501 A * 4/1998 Rapp ..... 248/201
5,754,991 A * 5/1998 Drozdowich et al. ..... 4/631
6,591,468 B1 * 7/2003 Douglas ..... 29/266

* cited by examiner

*Primary Examiner* — Robert Rose
(74) *Attorney, Agent, or Firm* — Wood, Herron & Evans, LLP

(57) ABSTRACT

A polishing stand for supporting a slab of solid material comprises a plurality of vertical supports, a horizontal platform attached to the vertical supports, and at least one clamp member attached to the horizontal platform, the clamp member comprising a vertical section that is coupled to the horizontal platform and horizontally adjustable to clamp a slab. A sink installation tool features an elongated connecting rod, a clamp head mounted to a first end of the connecting rod, and a flip foot mounted to a second end of said connecting rod. The flip foot is movable between a first position substantially parallel to the connecting rod, so that the flip foot may be inserted through the drain hole of a sink, and a second a second position where the flip foot is nonparallel to the connecting rod to engage a bottom surface of the sink.

2 Claims, 9 Drawing Sheets

GRANITE FINISHING TOOLS

CROSS REFERENCE TO RELATED APPLICATIONS

This application is a continuation in part of U.S. Provisional Patent Application Ser. No. 60/625,708, filed Nov. 5, 2004, which is hereby incorporated by reference herein in its entirety.

FIELD OF THE INVENTION

The present invention relates to tools for polishing and installing countertops or other slabs of solid, heavy material.

BACKGROUND OF THE INVENTION

Recently, homeowners have increasingly used natural materials such as granite or other stone materials for countertops in domestic kitchens. Such natural materials have advantages in durability, stain resistance and beauty over man-made surfaces. However, these materials suffer from the disadvantage that they are heavy and difficult to manipulate. The substantial weight of these materials renders them both difficult to fabricate and difficult to install.

Typically a stone supplier fabricates stone slabs by cutting the desired shape from raw pieces, and then polishing the cut piece to the designer's specification. The step of polishing the cut stone can be difficult to accomplish, as the edges are best accessed when the stone slab is set vertically on edge, so that the top edge is positioned to permit polishing. Not only is this vertical positioning difficult to achieve, but it is also difficult to reliably maintain. If the slab is not well balanced on edge or not held securely, there is a substantial risk that the slab will fall over and likely break upon impact.

Installation of stone countertops is also difficult, again due to their great weight. A particularly difficult procedure is the installation of an undermount sink beneath a countertop, which requires the undermount sink to be held in place beneath the countertop while mountings are installed in the underside of the countertop. The undermount sink is typically heavy and therefore difficult to hold in place underneath the countertop while mountings are being installed. This problem is exacerbated by the fact that often there is only room for one person to reach into the cabinet beneath the kitchen sink, and thus one person must simultaneously hold the sink in place and fasten mountings thereto.

SUMMARY OF THE INVENTION

The present invention provides tools that mitigate the difficulties described above, and permit more efficient fabrication and installation of stone and other heavy material countertops.

Specifically, in one aspect, the invention features a polishing stand for supporting a slab of solid material, comprising a plurality of vertical supports, a horizontal platform attached to the vertical supports, and at least one clamp member attached to the horizontal platform, the clamp member comprising a vertical section that is coupled to the horizontal platform and horizontally adjustable to clamp a slab.

In specific embodiments of this aspect, there is a horizontal connecter extending between the vertical supports, so that the vertical section clamps a slab between the vertical section and the horizontal connector. The horizontal connector and upper surface of the horizontal platform may include a pad for engaging the slab. In the specific disclosed embodiment, the clamp includes a pivoting mount connecting the vertical section to a base mounted to the horizontal platform. An adjuster pivots the pivoting mount relative to the base to clamp a slab.

In specific embodiments, the horizontal platform includes an extruded beam and an L bracket with a vertical and a horizontal portion mounted thereon, and the vertical section of the clamp clamps a slab between itself and the vertical portion of the horizontal platform. In this embodiment, the clamp includes a vertical section and a horizontal, threaded section attached thereto. The threaded horizontal section passes through an aperture in the extruded beam, and a nut is threaded on the horizontal section on the other side of the aperture, to horizontally adjust the position of the clamp.

In any of these embodiments, spacers may be inserted between the vertical section and the slab so that the spacer is clamped against the slab by the vertical section.

In a second aspect, the invention features a sink installation tool, and the method of its use. The tool features an elongated connecting rod, a clamp head mounted to a first end of the connecting rod, and a flip foot mounted to a second end of said connecting rod. The flip foot is movable between a first position substantially parallel to the connecting rod, so that the flip foot may be inserted through the drain hole of a sink, and a second a second position where the flip foot is nonparallel to the connecting rod to engage a bottom surface of the sink.

In particular disclosed embodiments, the clamp head has an adjustable mount permitting the clamp head to be adjustably mounted in plural positions on the connecting rod along its elongated direction, and a clamp screw adjustably extending from the clamp head substantially parallel to the connecting rod to permit clamping engagement of a sink positioned between the clamping head and the flip foot. The flip foot features first drain fitting projections, a first of which is sized to fit within a smaller sink drain hole and the second of which is sized to fit within a larger sink drain hole, to locate the flip foot within the drain hole.

The above and other objects and advantages of the present invention shall be made apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
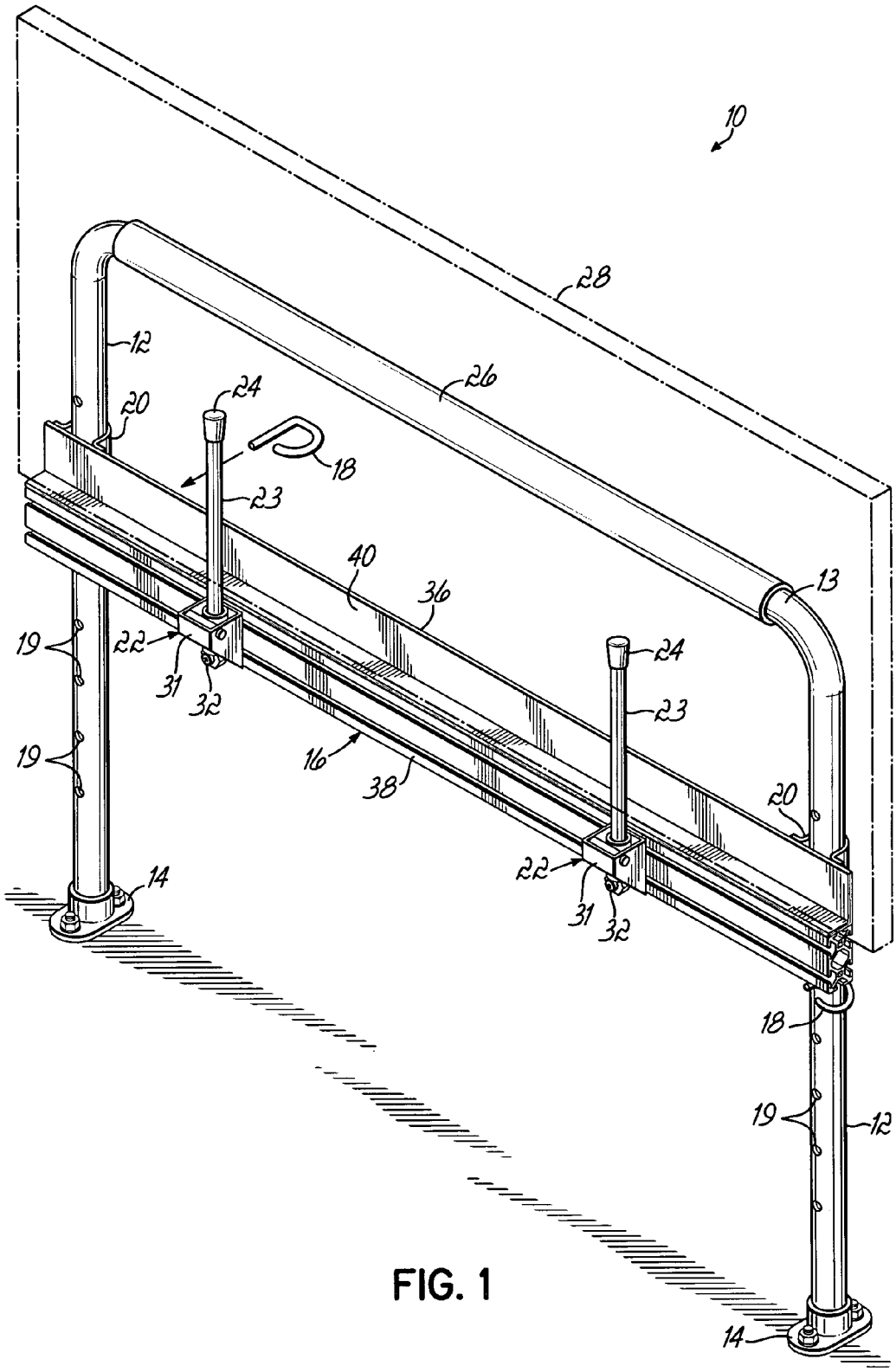
FIG. 1 is a perspective view of a first embodiment of a polishing stand, particularly suited for polishing larger slabs of solid material.
Figure 1A:
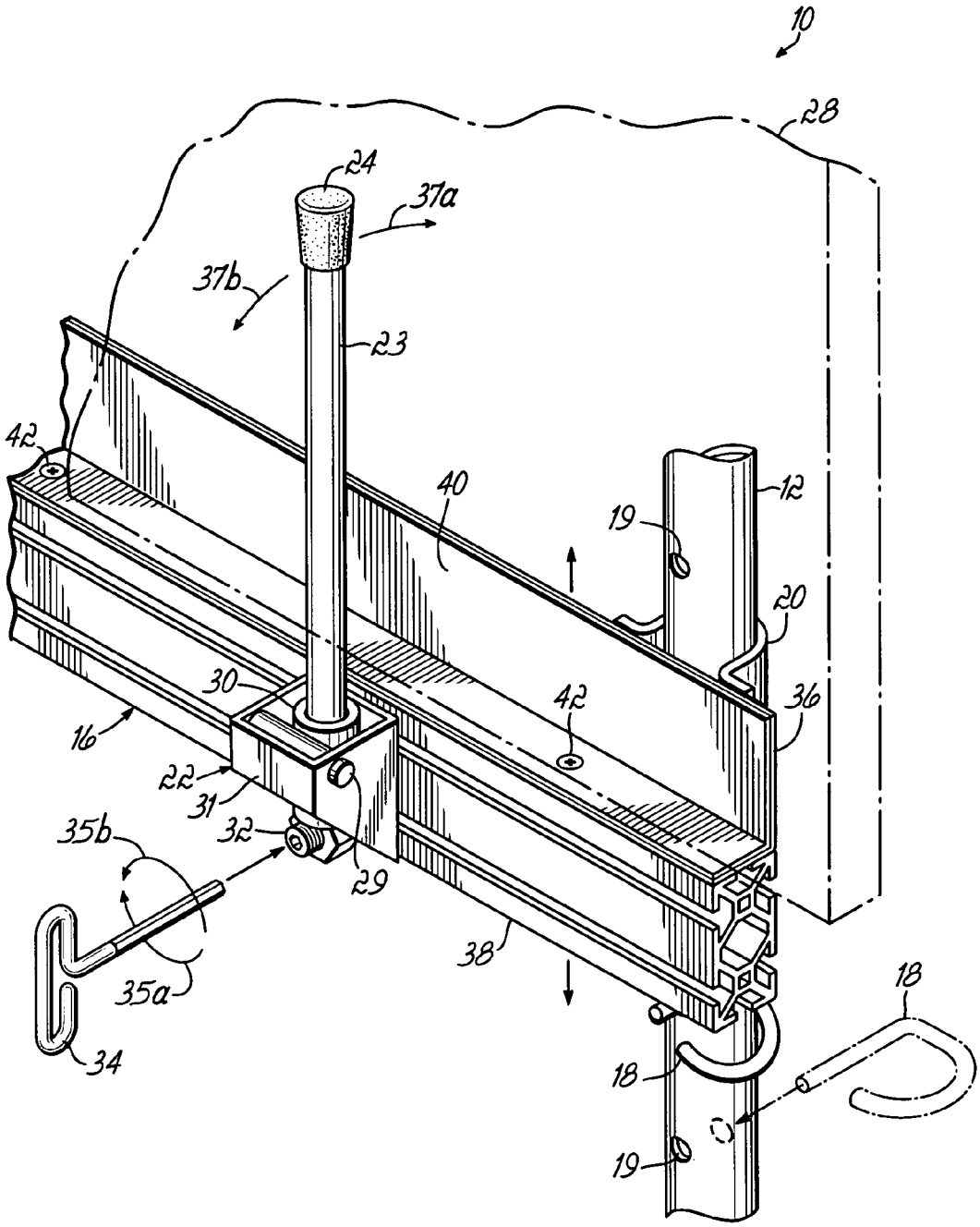
FIG. 1A is a detail view of the structure of the horizontal platform, clamp, and vertical supports of the stand of FIG. 1.
Figure 2:
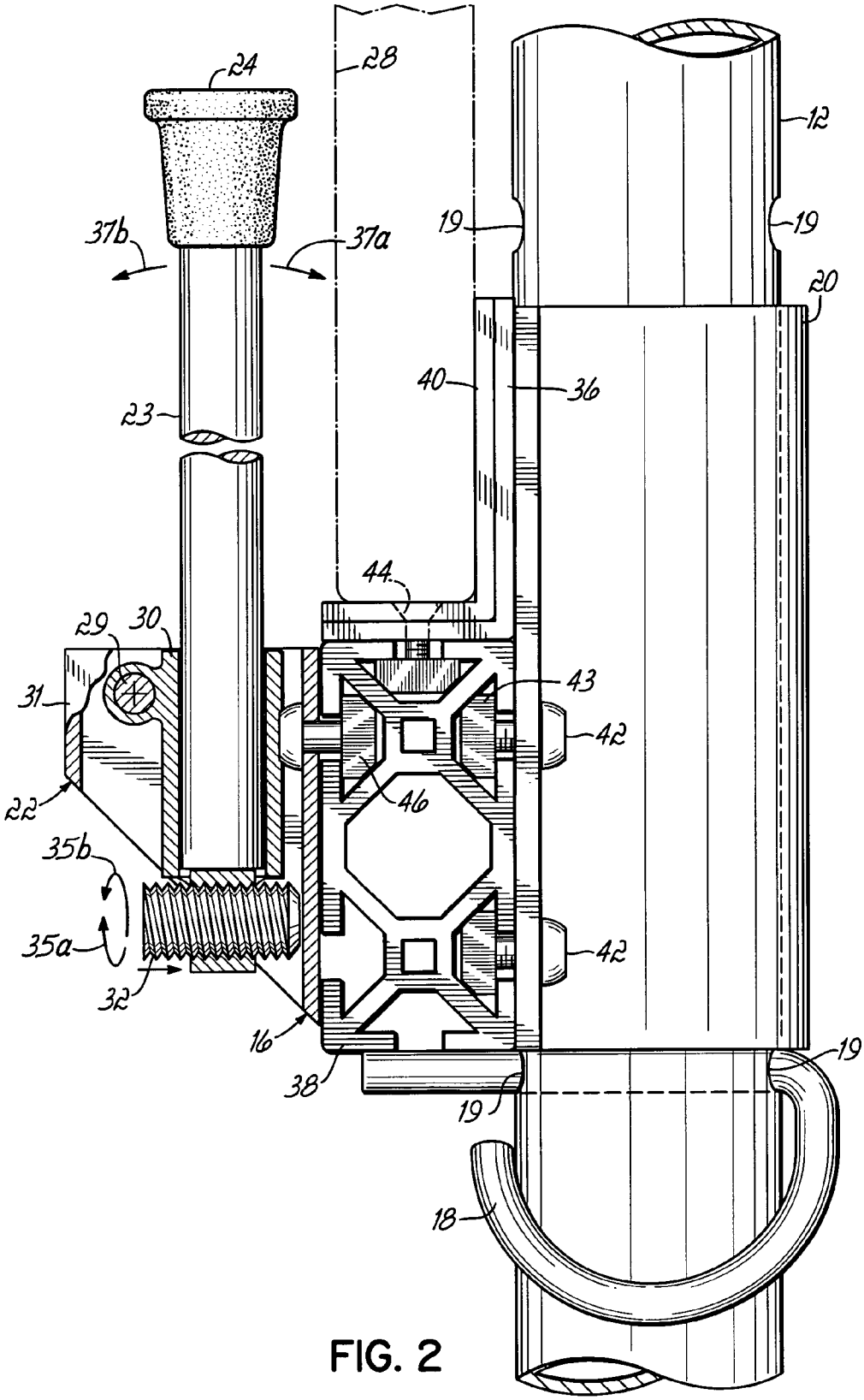
FIG. 2 is a cross sectional view taken through the clamp and horizontal platform of the stand of FIGS. 1 and 1A illustrating details of the clamp, horizontal platform, and the mounting of the horizontal platform to a vertical support.

Referring now to FIGS. 1, 1A and 2, a first embodiment 10 of a polishing stand in accordance with principles of the present invention, can be explained. The polishing stand comprises two vertical supports 12 extending from feet 14 which are mounted to the floor where the stand is used. The vertical sections are joined by a horizontal connector 13 to form a U-shaped main section of the stand. A horizontal platform 16 is mounted to the vertical supports 12, and held in place on the vertical supports 12 by sliders 20 and mounting pins 18. Sliders 20 enclose the vertical supports 12 and allow the horizontal platform 16 to slide vertically relative to the vertical supports.

The horizontal platform 16 is supported at a desired height by mounting pins 18, which are inserted through mounting holes 19 in vertical supports 12 at a desired position, and the platform 16 then rests upon the pins 18. As best seen in FIG. 1A, mounting pins 18 include a straight section and a curved section, and can be inserted into and removed from mounting holes 19 when the curved section is relatively parallel to the ground as shown in shadow in FIG. 1A. Once the mounting pin 18 is inserted, gravity causes the curved section to rotate downward to the position shown in solid lines in FIG. 1A, at which position the curved section of the mounting pin engages the cylindrical body of the vertical support 12, preventing removal of the mounting pin 18 until the mounting pin is again rotated against the force of gravity to a position approximately parallel to the ground. Locking pins 18 are thus self-locking once inserted.

Horizontal platform 16 has clamps engaged thereto which cause a vertically oriented slab 28 to be clamped against the horizontal connector 13. (Horizontal connector 13 carries a pad 26 to provide a soft surface for such clamping.) Specifically, along horizontal platform 16 are two clamp assemblies 22. Extending from each clamp 22 is a vertical section 23 which terminates in a padded cap 24. As best seen in FIG. 1A, vertical section 23 is pivotally mounted in a pivoting mount 30, which is connected by a pivot axle 29 to a clamp base 31. (Various lengths of section 23 may be used for slabs of various widths.) As seen in FIGS. 1A and 2, an adjustment screw 32 extends through a lower end of pivoting mount 30 and abuts the clamp base 31, to pivot the mount 30 and vertical section 23 to provide a clamping function. Specifically, adjustment screw 32 is threaded such that rotation thereof in a clockwise direction by use of a hex key adjustment wrench 34, as shown at arrow 35*a*, drives adjustment screw 32 into the lower end of pivoting mount 30 and into clamp base 31, forcing rotation of the pivoting mount 30 and vertical section 23 in the direction shown at 37*a*. When a slab 28 is positioned vertically resting upon the horizontal platform, motion of vertical section 23 in the direction 37*a* causes the slab to be clamped between the padded cap 24 on the vertical section 23 and the pad 26 on the horizontal connector 13, holding the slab tightly and securely in place to permit polishing. A slab is released from the clamp by reverse rotation of adjustment screw 32 in direction 35*b*, which causes movement of vertical section 23 in the direction 37*b*.

As best illustrated in FIGS. 1A and 2, horizontal platform 16 is comprised of an L shaped bracket 36 which is mounted atop an extrusion beam 38, having a horizontal portion and a vertical portion. A pad 40 is placed atop L-bracket 36 to protect slabs 28 placed on horizontal platform 16 from damage. Pad 40 and L-bracket 36 are mounted to extrusion beam 38 by a mounting screw 44, which is countersunk into pad 40 to permit flush mounting therein.

Extrusion beam 38 has a cross section including channels for attachment of various hardware, including slider mounting blocks 43 which are engaged by slider mounting screws 42 to hold a slider 20 to extrusion beam 38. Similarly, a clamp mounting block 46 slides within a channel on an opposite side of extrusion beam 38, engaged by a clamp base mounting screw to hold the clamp base 31 in a desired position on horizontal extrusion beam 38.

Figure 3:
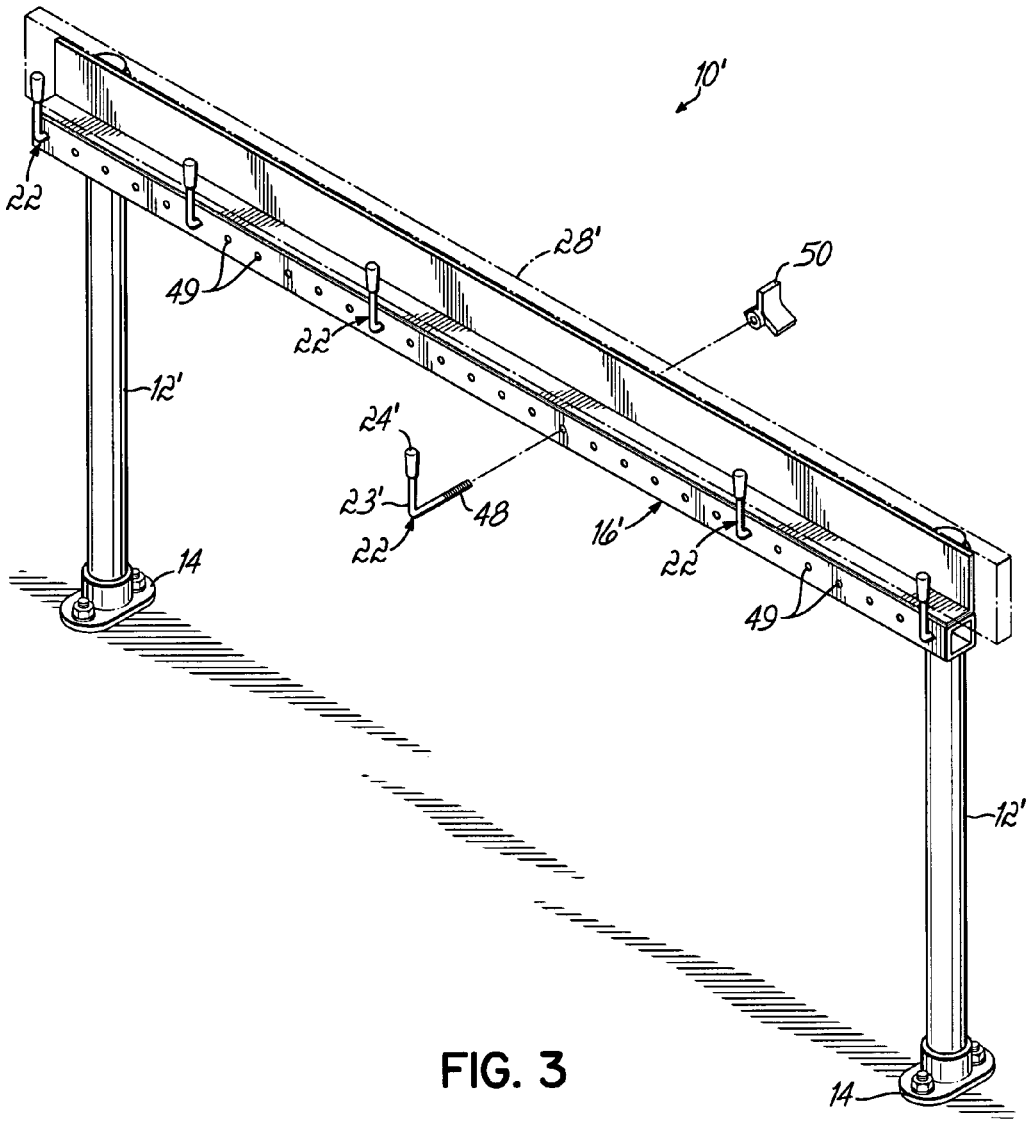
FIG. 3 is a perspective view of a second embodiment of a polishing stand, particularly suited for polishing smaller slabs of material such as a kitchen backsplash.
Figure 4:
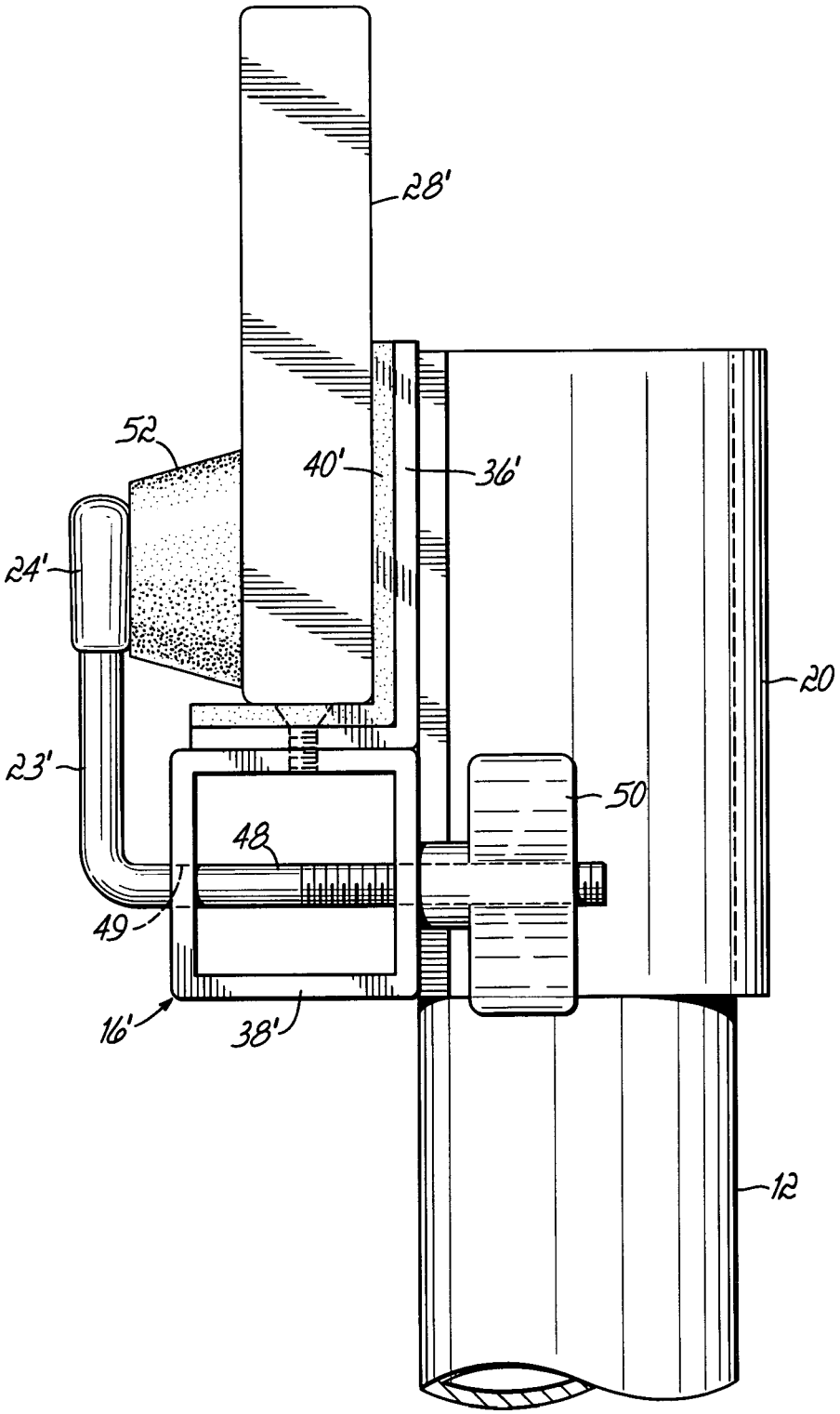
FIG. 4 is a cross section view taken through the horizontal platform of the stand of FIG. 3 illustrating details of the alternative embodiments of the clamp and horizontal platform used therein.

Referring now to FIGS. 3 and 4, a second embodiment 10' of a polishing stand in accordance with principles of the present invention, can be explained. This embodiment 10' utilizes vertical supports 12' and a horizontal platform 16', however, the clamping structures are distinct from those previously discussed. Specifically, the clamp members 22' comprise a bent bolt having a vertical section 23' with a cap 24' and a horizontal section 48 that is threaded. The horizontal section 48 is inserted through apertures 49 in the horizontal platform, and an adjuster nut 50 is threaded to the horizontal section 48 on an opposite side of horizontal platform 16' to form a clamp. Specifically, as adjuster nut 50 is threaded clockwise onto horizontal section 48, vertical section 23' is urged toward horizontal platform 16' to clamp a slab 28' in place.

A slab 28' is held in place in the embodiment 10' of FIGS. 3-4, by clamping the slab 28' between a clamp vertical section 23' and an L-bracket 36 of the horizontal platform 16'. As seen best in FIG. 4, the horizontal platform comprises an extruded beam 38', an L-bracket 36' and pad 40' bolted thereto by countersunk bolts, as discussed above. A relatively narrow elongated slab 28', such as used in a kitchen backsplash, is captured between the vertical sections 23' of the clamp members 22', and the vertical section of the L-bracket 36' and pad 40'.

It will be appreciated that the workpiece to be clamped may have a variable width. To accommodate a thinner workpiece, a spacer 52 is inserted between vertical section 23' of the clamp 22' and the slab 28', so that the horizontal adjustment of vertical section 23' can tightly clamp the slab 28'. Similar spacers may be used in the embodiment of FIGS. 1, 1A and 2 as needed for tight clamping and preservation of the workpiece.

Figure 5:
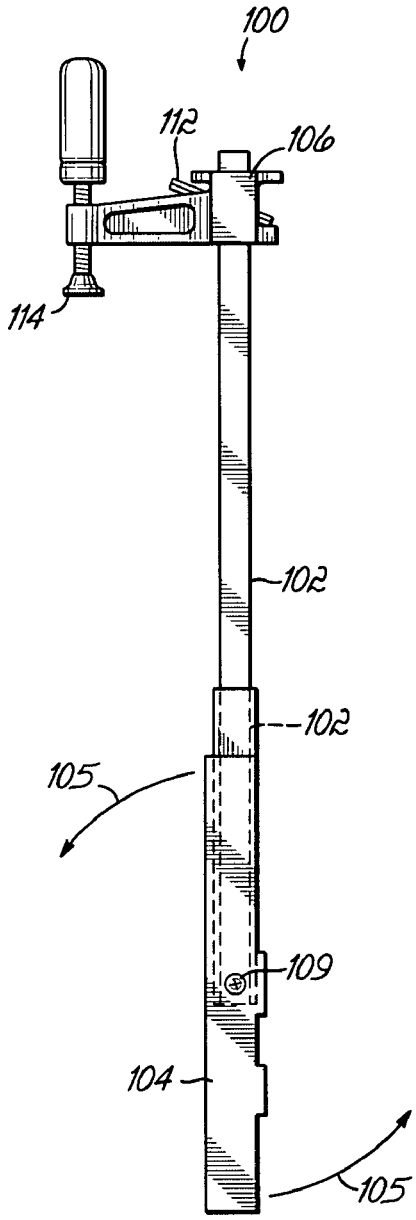
FIG. 5 is an illustration of an undermount sink installation tool, with the foot rotated for installation in an undermount sink drain hole.
Figure 6:
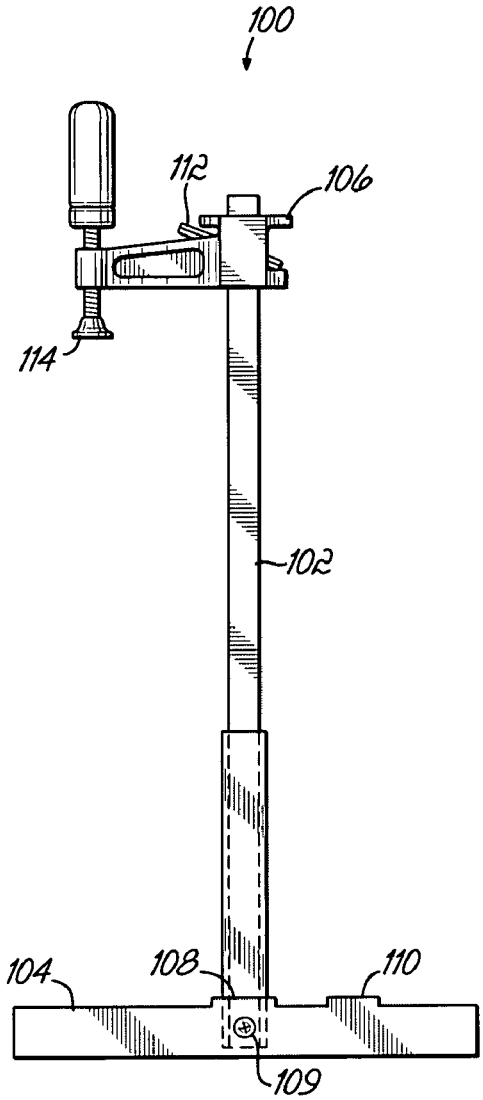
FIG. 6 is an illustration of the undermount sink installation tool of FIG. 5 with the foot rotated for engagement in the drain hole of an undermount sink.

Referring now to FIGS. 5 and 6, an undermount sink installation tool 100 can be explained. Tool 100 comprises an elongated bar 102 having a first end which is fitted with a flip foot 104 rotatable about axle 109, and a second end which is fitted with a clamp head 106.

Flip foot 104 is rotatable on axle 109, as shown at 105, between a first position shown in FIG. 5 in which flip foot 104 is substantially parallel to bar 102, and a second position shown in FIG. 6 in which flip foot 104 is nonparallel to bar 102. Flip foot 104 includes two projections 108 and 110 positioned as shown in FIG. 6 for engagement with the drain hole of a sink being mounted. Specifically, the small drain fitting projection 108 is sized to match the diameter of a small drain hole of a typical domestic sink. The large drain fitting projection 110 is positioned so that the space spanned by projections 108 and 110 taken together matches the size of a larger drain hole (such as for mounting a garbage disposal) of a typical domestic sink. Further details on the use of these drain holes is provided below with reference to FIGS. 7-9.

Clamp head 106 comprises an adjustable mount 112 as is conventionally known in bar clamping devices, which permits the clamp head to be adjustably positioned along bar 102 at a desired location. Clamp head 106 further includes a clamp screw 114 extending substantially parallel to bar 102 and providing final clamping force when tool 100 is in use.

Figure 7:
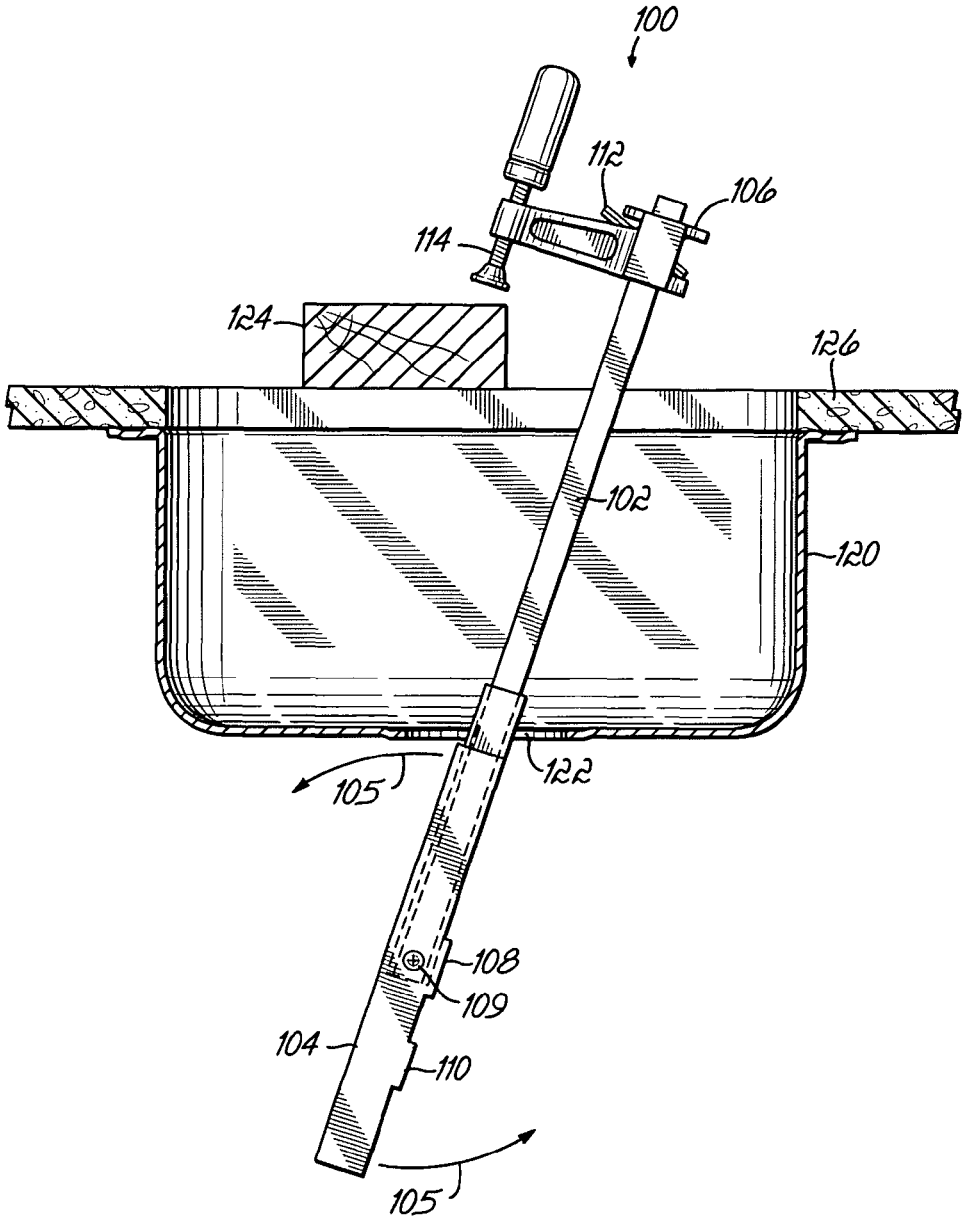
FIG. 7 is an illustration of the installation of the tool of FIGS. 5-6 into a large size drain hole of an undermount sink.
Figure 8:
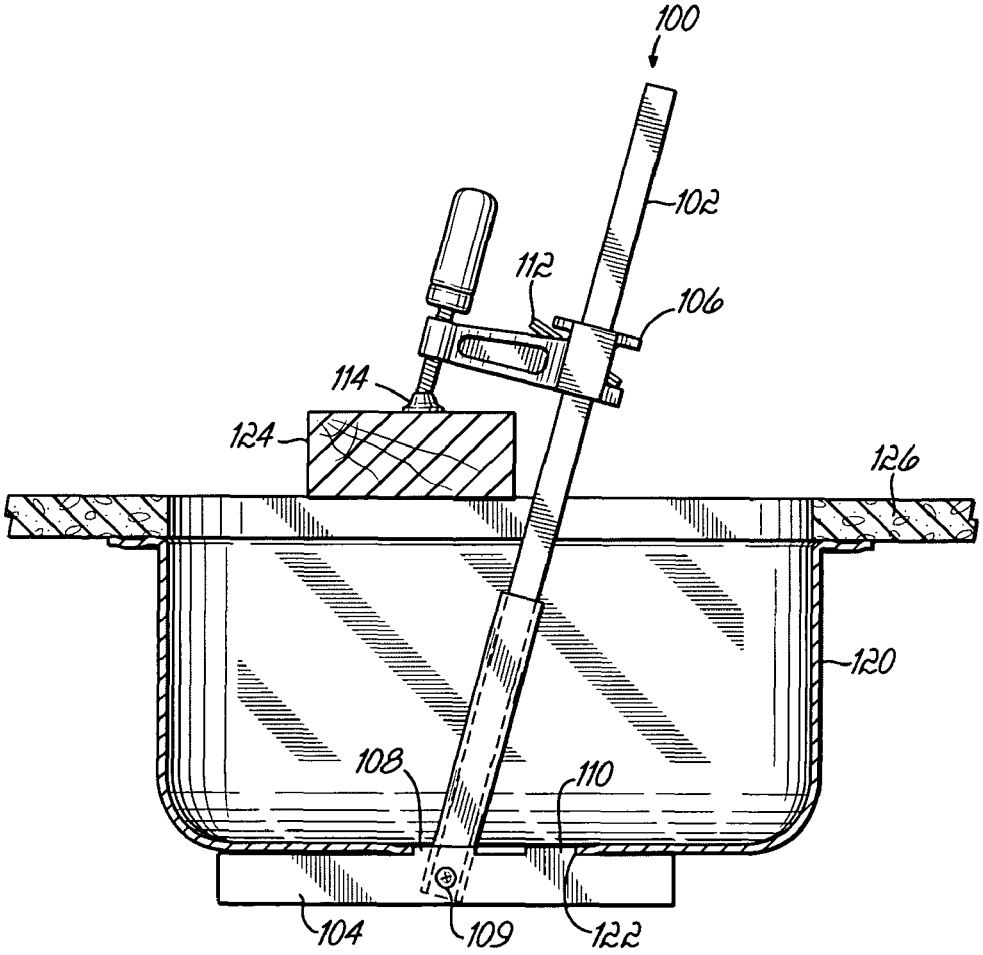
FIG. 8 is an illustration of the positioning of the foot of the tool of FIGS. 5-6 in a large size drain hole of an undermount sink.
Figure 9:
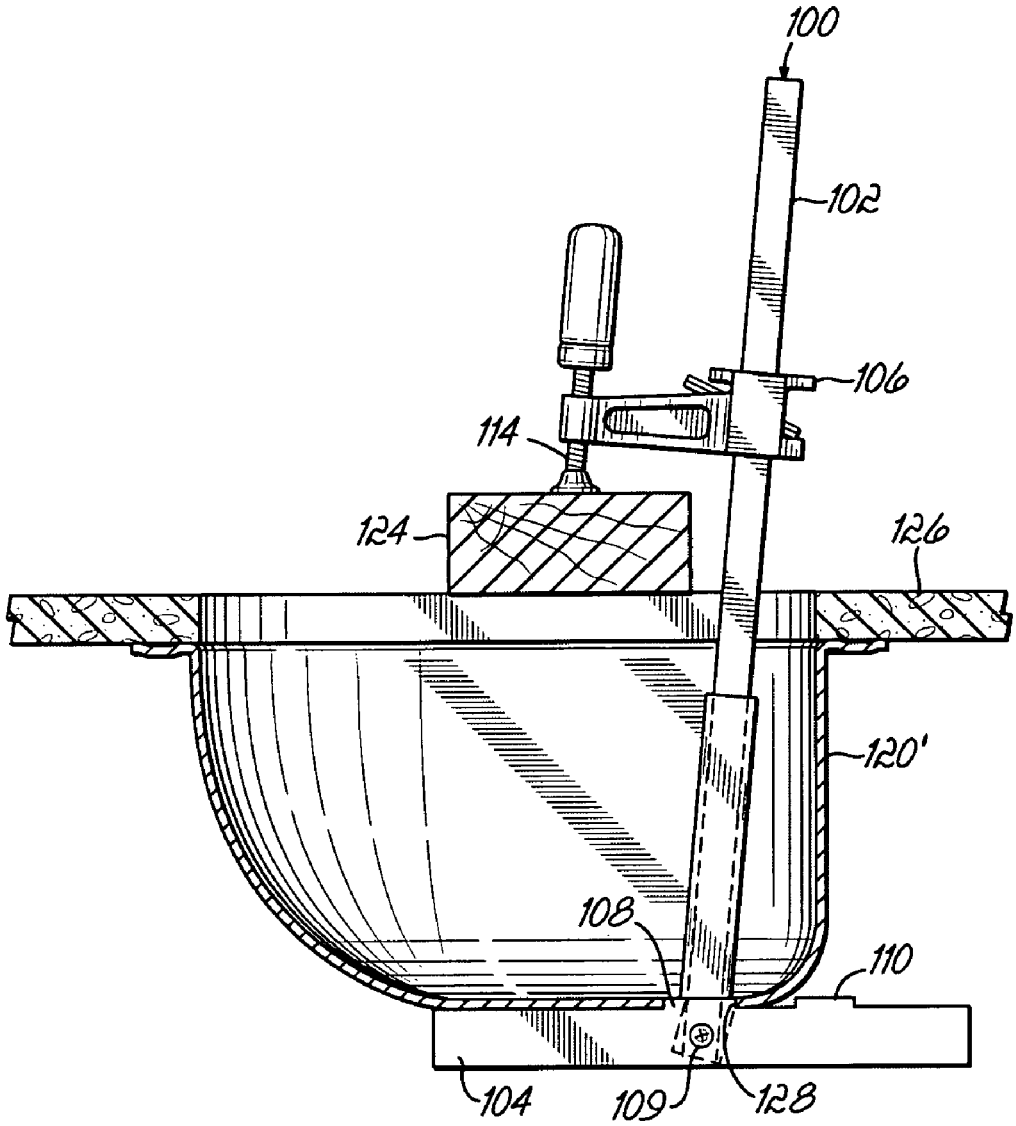
FIG. 9 is an illustration of the positioning of the foot of the tool of FIGS. 5-6 in a small size drain hole of an undermount sink.

Referring to FIGS. 7-9, use of tool 100 in mounting a sink can be explained. Initially, flip foot 104 is positioned parallel to bar 102 and inserted through the drain hole 122 of a sink 120. The sink 120 illustrated in FIGS. 7-8 has a large drain hole 122, e.g. for a garbage disposal, and has been positioned, typically by hand, beneath a countertop 126. After flip foot 104 has been inserted through drain hole 122, it is rotated as shown at 105 to a nonparallel position engaging drain hole 122, as seen in FIG. 8. The drain fitting projections 108 and 110 are then located inside of drain hole 122 to locate flip foot 104. A board 124 or other support is then positioned on the countertop 126 spanning the sink hole therein, and adjustable mount 112 is released to allow clamp head 106 to slide along bar 102 to put clamp screw 114 into engagement with board 124. Clamp screw 114 is then tightened to securely clamp sink 120 underneath countertop 126, which may then be mounted from the underside by conventional means.

FIG. 9 illustrates the use of tool 100 with an undermount sink 120' having a smaller drain hole 128, e.g., one that does not use a disposal. The steps for mounting the tool are similar to those previously discussed, with the exception that only the drain fitting projection 108 is fitted within the sink drain hole, the second projection 110 extending outside the drain area of the sink.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A method of installing an undermount sink to a countertop, comprising:

inserting a second end of an installation tool into a drain hole of said sink, the installation tool comprising an elongated connecting rod, a clamp head mounted to a first end of said connecting rod, and a flip foot mounted to said second end of said connecting rod, the flip foot being in a first position substantially parallel to said connecting rod during said inserting step, rotating said flip foot to a second position while said connecting rod is extending through said drain hole, said second position substantially nonparallel to said connecting rod, engaging said flip foot on a bottom surface of a sink while said connecting rod is extending through a drain hole thereof, and clamping said clamp head to said countertop thereby moving said elongated connecting rod to an acute angle relative to vertical and drawing said undermount sink to said countertop by clamping between said clamp head and flip foot.

2. The method of claim 1 wherein said flip foot comprises a drain fitting projection, the drain fitting projection sized to fit within a drain hole of a sink when said flip foot is rotated to said second position, said engaging step comprising locating said drain fitting projection within said drain hole.

* * * * *